United States Patent [19]

Pearson, Jr.

[11] 3,968,591

[45] July 13, 1976

[54] COMBINED SPOON AND TOY

[76] Inventor: Karl Henry Pearson, Jr., R.D. No. 1, Prosperity, Pa. 15329

[22] Filed: Dec. 6, 1971

[21] Appl. No.: 205,218

[52] U.S. Cl. ..... 46/1 R

[51] Int. Cl.[2] ..... A63H 33/00

[58] Field of Search ..... 46/116, 145, 1 R; D54/12

[56] References Cited

UNITED STATES PATENTS 2,787,055 4/1957 Wertz ..... 30/123

*Primary Examiner*—Louis G. Mancene
*Assistant Examiner*—Jack Q. Lever
*Attorney, Agent, or Firm*—William J. Ruano

[57] ABSTRACT

A combined spoon and toy for providing an incentive to small children to enjoy eating their food. The toy is integrally interposed between the ladle and handle portions of the spoon.

1 Claim, 11 Drawing Figures

COMBINED SPOON AND TOY

This invention relates to the combination of a spoon and toy.

In the past, spoons have been made ornamental, such as those serving as souvenirs for historical occasions. However, these are not useful for providing an incentive for small children to eat since the ornamentation is almost invisible, especially to small children.

An object of the present invention is to provide a novel combination of toy and spoon which is so constructed that a child will enjoy food offered to him since the toy portion provides a very substantial incentive to eat from the spoon and encourages self-feeding.

A more specific object of the invention is to provide a novel spoon and toy combination wherein the toy is of substantial size, comparable to that of the ladle portion of the spoon.

Other objects and advantages of the present invention will become apparent from a study of the following description taken with the accompanying drawings wherein.

Figure 1:
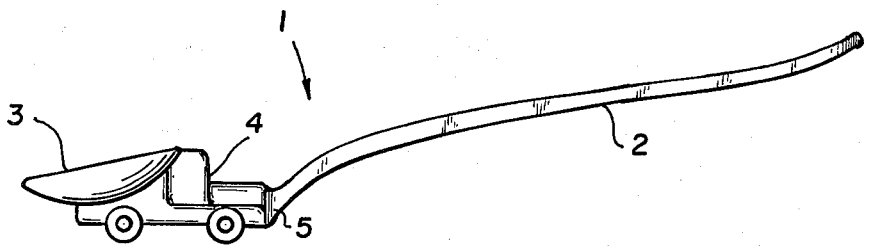
FIG. 1 is a side view and FIG. 2 is a top view of a combined spoon and toy embodying the present invention wherein the latter is in the form of a truck.
Figure 2:
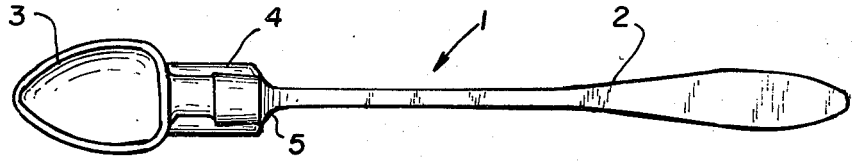

Referring more particularly to FIGS. 1 and 2 of the drawings, numeral 1 generally denotes a spoon and toy combination to provide an incentive to children to eat from the spoon. The combination comprises a spoon handle 2, ladle portion 3 and an integral toy portion therebetween in the form of a toy truck 4 integrally secured at 5 to the handle. The combination may be made of any suitable material, such as plastic or metal. By such arrangement the wheels of the truck may be slid along the top surface of a table or highchair tray immediately before the spoon ladle portion 3 is brought to the mouth of the child. This action, coupled with encouraging remarks of the parent, would be in the nature of a game which would easily obtain the cooperation of the child who might otherwise be difficult to feed.

Figure 3:
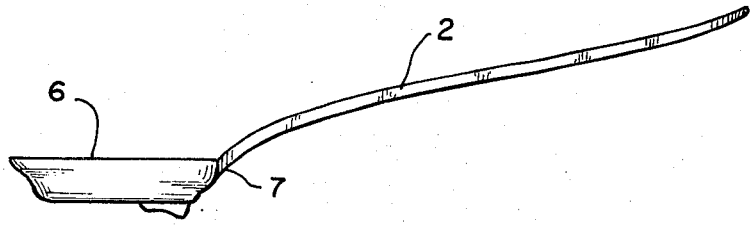
FIG. 3 is a side view and FIG. 4 is a top view of a combined spoon and boat.
Figure 4:
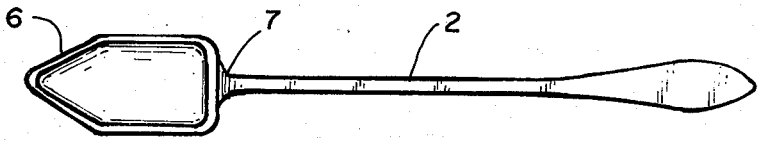

FIGS. 3 and 4 show a modification comprising a slightly pointed ladle portion 6 integrally joined at 7 to handle 2.

Figure 5:
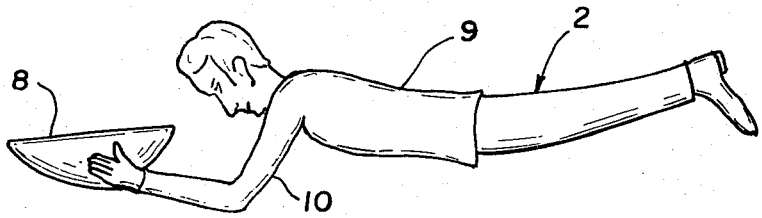
FIG. 5 is a side view of a male doll and spoon combination.

FIG. 5 shows a male doll 9 serving as the handle,- the doll having arms 10 supporting the ladle portion 8 in integral relationship.

Figure 6:
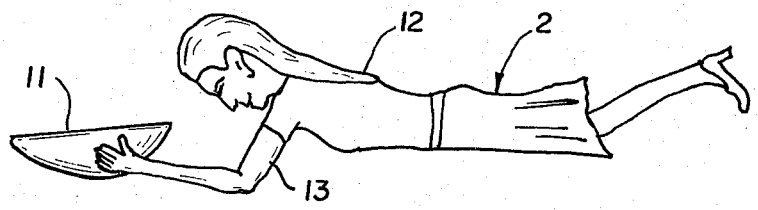
FIG. 6 is a side view of a female doll and spoon combination and FIG. 7 is a top view thereof.
Figure 7:
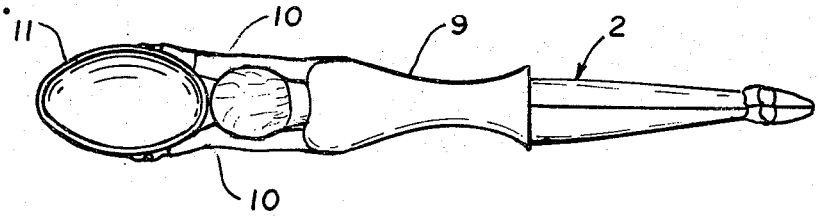

FIGS. 6 and 7 show a female doll 12 whose arms 13 support a ladle 11.

Figure 8:
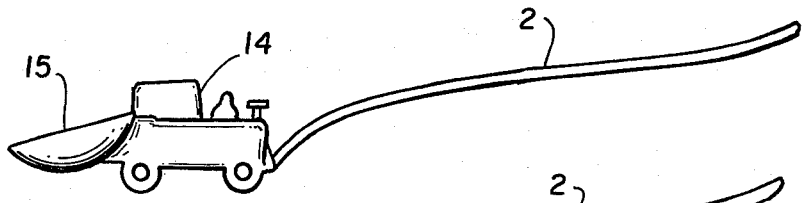
FIG. 8 is a side view of a combined spoon and locomotive.

FIG. 8 shows another form comprising a toy locomotive 14 integrally secured to ladle 15.

Figure 9:
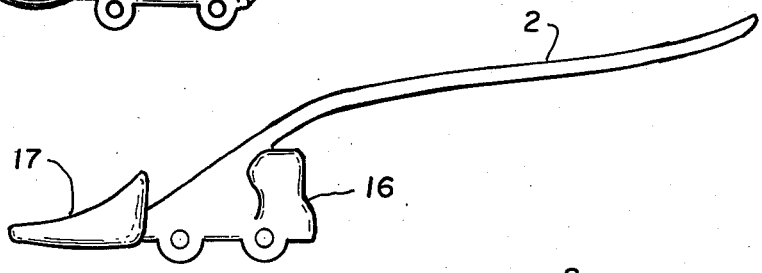
FIG. 9 is a side view of a combined spoon and bulldozer.

FIG. 9 shows a further modification embodying a bulldozer vehicle 16 with a scoop 17.

Figure 10:
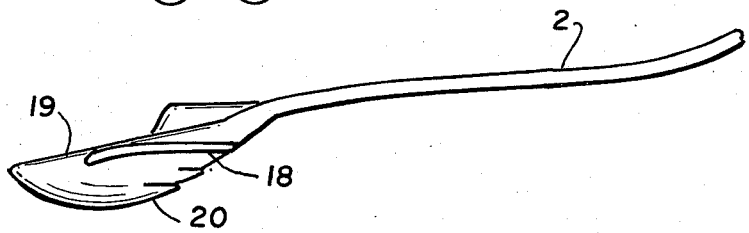
FIG. 10 is a side view and FIG. 11 is a top view of a combined spoon and boat modification.
Figure 11:
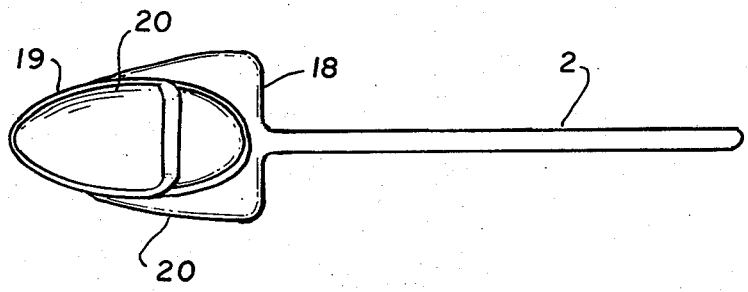

FIGS. 10 and 11 show a further modification in the form of a boat 18 having a bottom portion 20 and which is hollowed out at 19 to form a ladle portion which encourages drinking soups.

Similarly, other designs of toys may be integrally formed with the ladle portion and handle portion to form a combined spoon and toy that will attract children and instill cooperation in feeding from a spoon. While a spoon has been described, it will be readily apparent that a fork may be used instead in the designs illustrated.

Thus it will be seen that I have provided a very attractive and efficient combined spoon and toy that will provide great incentive and pleasure to small children when feeding from a spoon so as to obtain their cooperation in eating substantially more than they would otherwise eat from a plain spoon.

While I have illustrated and described several modifications of my invention, it will be understood that these are by way of illustration only and that various changes and modifications may be contemplated within the scope of the following claims.

I claim:

1. A combined spoon and toy for feeding an infant or small child, comprising a ladle like portion integrally secured to and extending forwardly in front of a portion simulating a truck, and a handle portion having one end integrally attached to the rear end of said truck and extending longitudinally rearwardly thereof, whereby as the handle portion is grasped so as to push and slide the truck portion on a table surface, it will provide attraction to the infant or small child by simulating a motor-driven cargo for feeding.

* * * * *